US009603418B2

(12) United States Patent
Grimm et al.

(10) Patent No.: US 9,603,418 B2
(45) Date of Patent: Mar. 28, 2017

(54) ROTATABLE BUCKLE ASSEMBLY

(71) Applicant: ILLINOIS TOOL WORKS INC., Glenview, IL (US)

(72) Inventors: Michael B. Grimm, Evanston, IL (US); Christopher A. J. Iannello, Rolling Meadows, IL (US); Martin J. Nilsen, Hampshire, IL (US)

(73) Assignee: Illinois Tool Works Inc., Glenview, IL (US)

( * ) Notice: Subject to any disclaimer, the term of this patent is extended or adjusted under 35 U.S.C. 154(b) by 175 days.

(21) Appl. No.: 14/391,716

(22) PCT Filed: Apr. 16, 2013

(86) PCT No.: PCT/US2013/036729

§ 371 (c)(1),
(2) Date: Oct. 10, 2014

(87) PCT Pub. No.: WO2013/158609

PCT Pub. Date: Oct. 24, 2013

(65) Prior Publication Data

US 2015/0074957 A1 Mar. 19, 2015

Related U.S. Application Data

(60) Provisional application No. 61/625,751, filed on Apr. 18, 2012.

(51) Int. Cl.
*A41F 3/04* (2006.01)
*A44B 11/25* (2006.01)

(52) U.S. Cl.
CPC ..... *A44B 11/25* (2013.01); *A44B 11/2592* (2013.01); *Y10T 24/45241* (2015.01); *Y10T 24/45623* (2015.01); *Y10T 24/45675* (2015.01)

(58) Field of Classification Search
CPC . A44B 11/25; A44B 11/2592; A44B 11/2534; Y10T 24/45241; Y10T 24/45623; Y10T 24/45675; Y10T 24/45524; Y10T 24/45529; Y10T 24/45581
See application file for complete search history.

(56) References Cited

U.S. PATENT DOCUMENTS 4,443,916 A 4/1984 Tiemann
4,612,687 A 9/1986 Barwood
5,263,234 A * 11/1993 Fudaki ..... A44B 11/263 24/615
5,319,836 A * 6/1994 Ida ..... A44B 11/263 24/614
D349,871 S * 8/1994 Murai ..... D11/200
(Continued)

OTHER PUBLICATIONS

ISR and WO for PCT/US2013/036729 mailed Jul. 24, 2013.

*Primary Examiner* — Victor Batson
*Assistant Examiner* — Matthew Sullivan
(74) *Attorney, Agent, or Firm* — Joseph M. Butscher; The Small Patent Law Group, LLC

(57) ABSTRACT

A rotatable buckle assembly may include a male buckle member, and a female buckle member configured to rotatably connect to the male buckle member. The female buckle member may include a handle that is configured to be pulled to disconnect the first buckle member from the second buckle member.

20 Claims, 5 Drawing Sheets

(56) References Cited

U.S. PATENT DOCUMENTS

| | | | | | |
|---|---|---|---|---|---|
| 5,471,716 | A * | 12/1995 | Takahashi | A44B 11/263 | 24/589.1 |
| 5,860,769 | A * | 1/1999 | Seligman | A44B 11/263 | 224/264 |
| 7,198,183 | B2 * | 4/2007 | Yang | A45F 3/12 | 206/315.3 |
| 2006/0070215 | A1 * | 4/2006 | Sung | A44B 11/006 | 24/615 |
| 2009/0255101 | A1 | 10/2009 | Lin | | |

* cited by examiner

ROTATABLE BUCKLE ASSEMBLY

RELATED APPLICATIONS

The present application is a National Phase of PCT/US2013/036729 filed Apr. 16, 2013 and relates to and claims priority benefits from U.S. Provisional Patent Application No. 61/625,751 filed Apr. 18, 2012, which is hereby incorporated by reference in its entirety.

FIELD OF EMBODIMENTS OF THE DISCLOSURE

Embodiments of the present disclosure generally relate to a buckle assembly, and, more particularly, to a buckle assembly having first and second buckle members that may rotate or pivot with respect to one another in a connected state.

BACKGROUND

Buckles are used to securely connect components together. For example, various bags, backpacks, and the like have male and female buckle members connected to straps, webbing, or the like. Each strap, for example, is looped through a web channel on a buckle member. In order to connect the straps together, the male buckle member is connected to the female buckle member.

In certain applications, it is desirable to allow the buckle members to pivot or rotate with respect to one another while connected. Pivoting or rotating buckle assemblies may be used to provide comfort and easier adjustment. For example, a backpacker may shift or rotate a buckle assembly of the backpack in order to provide a more comfortable fit.

A known rotating buckle assembly includes a female buckle member having a slot into which a male buckle member is inserted. The male buckle member includes a central circular button that flexes through a circular recess formed in the female buckle member. The buckle members are configured to allow the buckle members to pivot or rotate about an axis of the circular button. In order to disconnect the male buckle member from the female buckle member, the circular button is pushed in a direction that is parallel to the pivot axis.

However, the circular button is generally exposed, and may be inadvertently engaged by the buckle assembly abutting into other objects. Moreover, the circular button may be over-flexed, thereby causing material fatigue, and causing the circular button to malfunction. Further, the circular button is susceptible to being broken away from the male buckle member.

SUMMARY OF EMBODIMENTS OF THE DISCLOSURE

Certain embodiments of the present disclosure provide a rotatable buckle assembly that may include a first buckle member, such as a male buckle member, and a second buckle member, such as female buckle member. The first buckle member may include an insertion member. The second buckle member is configured to rotatably connect to the first buckle member. The second buckle member may include a handle and an insertion channel configured to receive the insertion member. The insertion member is rotatably retained within the insertion channel when the first buckle member is rotatably connected to the second buckle member. The handle is configured to be pulled to disconnect the first buckle member from the second buckle member.

The insertion member may include an internal stud that conforms to a contour of a portion of the second buckle member. The internal stud may be configured to be rotatably retained by the portion of the second buckle member. The second buckle member may include opposed pivot beams connected to the handle. The handle may also include an arcuate internal edge that rotatably engages the internal stud. The opposed pivot beams may be positioned over a plane, such as a plane that contains an exposed upper surface, of the internal stud.

The handle may also include a lanyard opening configured to retain a lanyard that is configured to be grasped and pulled. The handle may also include an upturned end that is configured to be grasped and pulled.

The second buckle member may include a base having an outer receiving edge with recessed lateral portions that are configured to limit rotatable movement of the first buckle member with respect to the second buckle member. The insertion member may include arcuate openings. The handle may further include securing protrusions configured to be slidably retained within the arcuate openings when the first buckle member is rotatably connected to the second buckle member. The first buckle member may be configured to pivot through an arc of +/−30° with respect to a central axis of the second buckle member, or vice versa.

Figure 1:
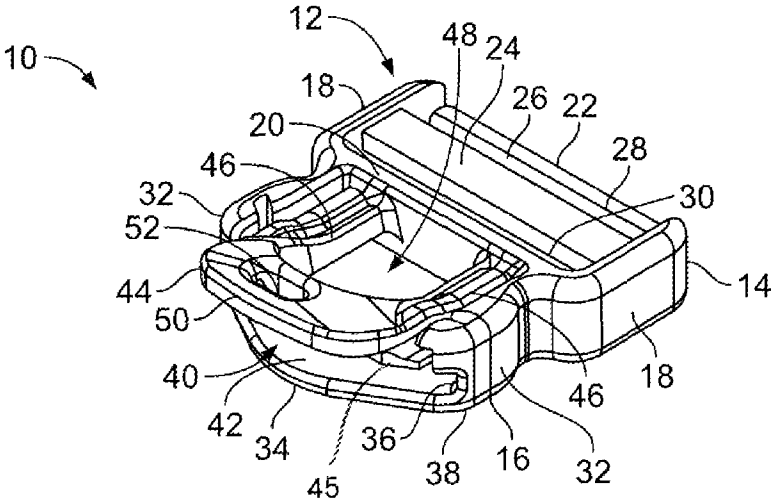
FIG. 1 illustrates an isometric top view of a female buckle member, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

FIG. 1 illustrates an isometric top view of a female or first buckle member 10, according to an embodiment of the present disclosure. The female buckle member 10 may be formed of plastic, metal, and/or the like. For example, the female buckle member 10 may be integrally molded and formed as a single piece of injection-molded plastic. The female buckle member 10 may include a main housing 12 having a web-retaining portion 14 and a male-receiving portion 16.

The web-retaining portion 14 includes opposed lateral walls 18 connected to a strut 20 that may be generally perpendicular to the lateral walls 18. A web-receiving crossbeam 22 and a web-securing crossbeam 24 span between the opposed lateral walls 18. A web passage 26 is defined between the web-receiving crossbeam 22, the web-securing crossbeam 24, and the strut 20. The web passage 26 includes an receiving opening 28 and a securing opening 30. The web passage 26 is configured to receive and adjustably retain a web member, such as a strap, webbing, rope, string, and/or the like.

The male-receiving portion 16 includes opposed lateral walls 32 integrally connected to a planar base 34 that spans between the lateral walls 32. The lateral walls 32 and the base 34 may integrally connect to the strut 20. Notches 36 may be formed proximate to front ends 38 of the lateral walls 32. The notches 36 are configured to receive lateral arms of a male insertion member. As such, an insertion channel 40 is defined between an upper surface 42 of the base 34 and the notches 36. Alternatively, the notches 36 may not be formed in the lateral walls 32, in which case the insertion channel 40 is defined between the upper surface 42 of the base 34 and interior surfaces of the lateral walls 32.

A securing latch 44 extends over the insertion channel 40. Over-pull tabs 45 may be positioned under portions of the securing latch 44, and prevent the securing latch 44 from being over-extended and/or breaking. The securing latch 44 includes opposed flexible pivot beams 46 that outwardly extend from the strut 20 over the insertion channel 40 proximate to the lateral walls 32. A central space 48 separates the pivot beams 46. The pivot beams 46 may generally be perpendicular to the strut 20 and extend in an opposite direction from the web-retaining portion 14. Distal ends of the pivot beams 46 connect to a handle 50, which connects both pivot beams 46 together. The handle 50 may be cross-wise to the pivot beams 46. A lanyard opening 52 may be formed through a portion of the upturned handle 50. The lanyard opening 52 is configured to securely retain a lanyard, rope, string, or the like, which may be used to pull the securing latch 44.

Figure 2:
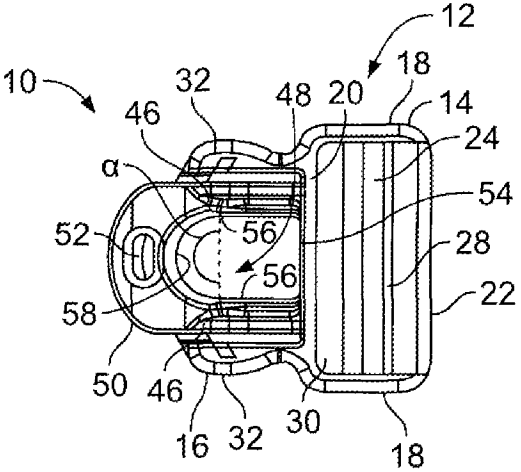
FIG. 2 illustrates a top view of a female buckle member, according to an embodiment of the present disclosure.

FIG. 2 illustrates a top view of the female buckle member 10. The central space 48 may be defined by a straight interior edge 54 of the strut 20, straight interior edges 56 of the pivot beams 46, and an arcuate interior edge 58 of the handle 50. The arcuate interior edge 58 may be a semi-circular edge. For example, the arcuate interior edge 58 may span a radial angle θ, which may be 180°. Alternatively, the radial angle θ may be greater or less than 180°.

Figure 3:
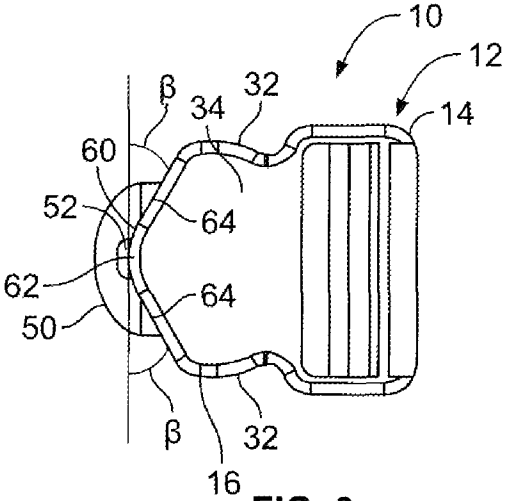
FIG. 3 illustrates a bottom view of a female buckle member, according to an embodiment of the present disclosure.

FIG. 3 illustrates a bottom view of the female buckle member 10. The base 34 may include an outer receiving edge 60 having a central apex or tip 62 and recessed lateral portions 64, such as wings, that span between the apex 62 and the lateral walls 32. The recessed lateral portions 64 may recede away from the apex at an angle β, which may be between 20°-45°. Alternatively, however, the angle β, may be less than 20° or greater than 45°. The recessed lateral portions 64 provide barriers past which a male connection member is prevented from rotating. As such, the recessed lateral portions 64 may dictate the pivotal range of the female buckle member 10 in relation to a male buckle member.

Figure 4:
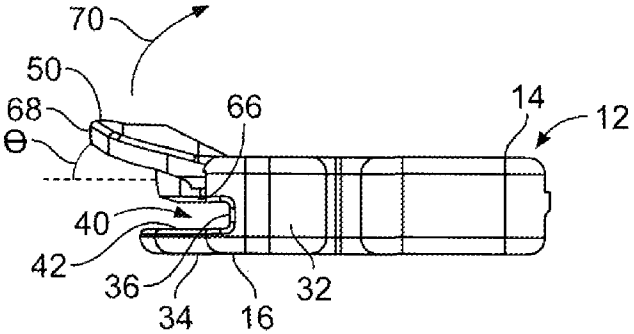
FIG. 4 illustrates a lateral view of a female buckle member, according to an embodiment of the present disclosure.

FIG. 4 illustrates a lateral view of the female buckle member 10. As noted above, the insertion channel 40 may be defined between an upper surface 42 of the base 34 and the notches 36 formed in the lateral walls 32. A lower surface 66 of the handle 50 may be positioned over an open end of the insertion channel 40.

The handle 50 may include a graspable upturned end 68, which may be upwardly canted at an angle θ with respect to the lower surface 66. The angle θ may be between 10°-25°, for example. Alternatively, however, the angle θ may be less than 10° or greater than 25°. Additionally, the handle 50 may not include the upturned end 68. Instead, the entirety of the handle 50 may be a longitudinal beam that is parallel with the base 34. In operation, the handle 50 is configured to be grasped by a user and pulled upward in the direction of arc 70. Optionally, the user may grasp a lanyard looped through the lanyard opening 52 and pull in the direction of arc 70. When the handle 50 is pulled in the direction of arc 70, the flexible beams 46 (shown in FIGS. 1 and 2) upwardly pivot about areas proximate to the strut 20 (shown in FIGS. 1 and 2). When the user disengages the handle 50, the flexible beams 46 flex back down to their at-rest positions, and the handle 50 returns to the position shown in FIG. 4.

Figure 5:
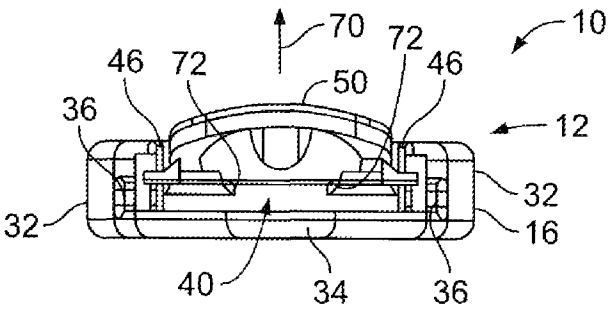
FIG. 5 illustrates a male-receiving end view of a female buckle member, according to an embodiment of the present disclosure.

FIG. 5 illustrates a male-receiving end view of the female buckle member 10. One or more securing protrusions 72 may extend from the handle 50 or the pivot beams 46. The securing protrusions 72 may be barbs, clasps, latches, or the like that are configured to be retained within reciprocal structures of a male buckle member, such as arcuate channels formed around portions of an interior stud. Thus, in the connected position, the securing protrusions 72 may be slidably retained within channels, for example, formed through a portion of a male buckle member. In order to remove the securing protrusions 72 from the channels, the handle 50 is pulled upward in the direction of arc 70, thereby disengaging the securing protrusions from reciprocal channels.

Figure 7:
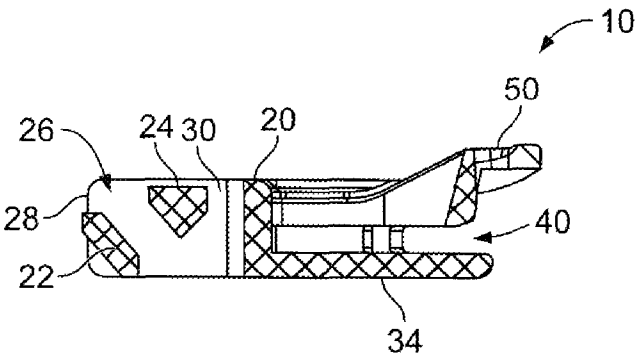
FIG. 7 illustrates a cross-sectional view of a female buckle member through line 7-7 of FIG. 6, according to an embodiment of the present disclosure.
Figure 6:
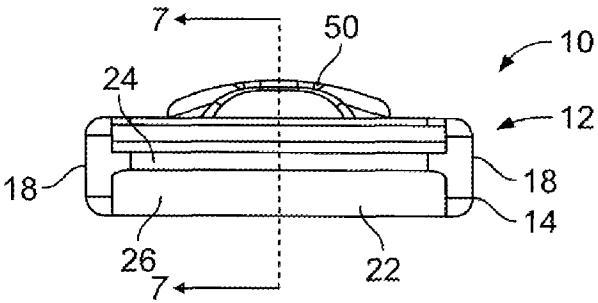
FIG. 6 illustrates a web-retaining end view of a female buckle member, according to an embodiment of the present disclosure.

FIG. 6 illustrates a web-retaining end view of the female buckle member 10. FIG. 7 illustrates a cross-sectional view of the female buckle member 10 through line 7-7 of FIG. 6. Referring to FIGS. 6 and 7, as noted above, the web-retaining portion 14 includes the web passage 26, into which a web member, such as webbing, a strap, rope, string, or the like, is adjustably retained.

Figure 8:
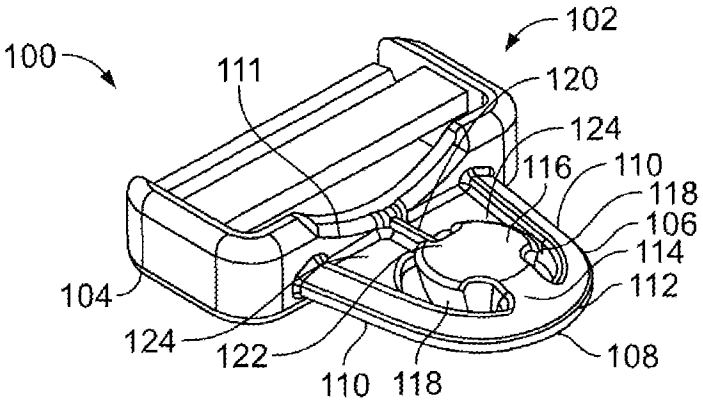
FIG. 8 illustrates an isometric top view of a male buckle member, according to an embodiment of the present disclosure.
Figure 10:
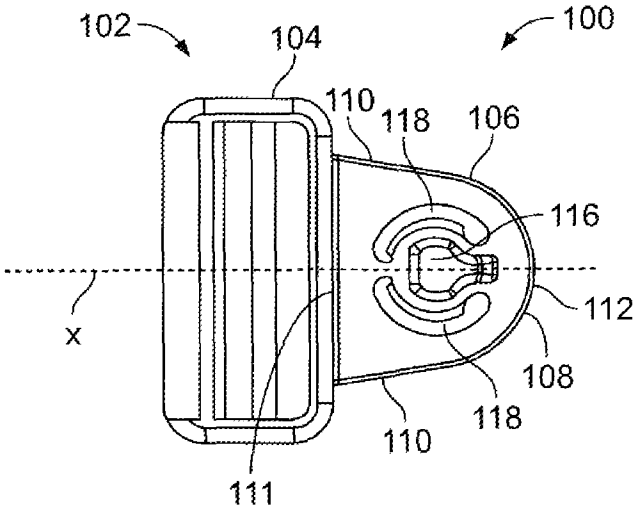
FIG. 10 illustrates a bottom view of a male buckle member, according to an embodiment of the present disclosure.
Figure 9:
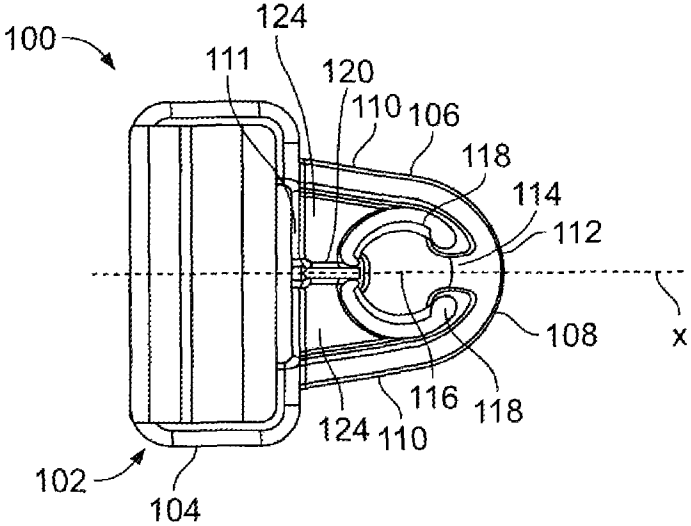
FIG. 9 illustrates a top view of a male buckle member, according to an embodiment of the present disclosure.

FIG. 8 illustrates an isometric top view of a male or second buckle member 100, according to an embodiment of the present disclosure. It is to be understood that the male buckle member 100 may be considered the first buckle member, while the female buckle member 10 may be considered the second buckle member, or vice versa. FIG. 9 illustrates a top view of a male buckle member 100, while FIG. 10 illustrates a bottom view of a male buckle member 100. Referring to FIGS. 8-10, the male buckle member 100 may be formed of plastic, metal, and/or the like. For example, the male buckle member 100 may be integrally molded and formed as a single piece of injection-molded plastic. The male buckle member 100 may include a main housing 102 having a web-retaining portion 104 and a female-insertion portion 106. The web-retaining portion 14 may be similar to the web-retaining portion 14 of the female buckle member 10 described above.

The female-insertion portion 106 includes an insertion member 108, such as a tongue, prong, beam, tab, or the like. The insertion member 108 may include lateral arms 110 that extend from central a strut 111 in a direction opposite from the web-retaining portion 104. The lateral arms 110 are integrally connected to an arcuate outer tip 112 that may generally conform to the shape of the arcuate interior edge 58 of the handle 50 (shown in FIG. 2). As shown in FIGS. 9 and 10, in particular, the lateral arms 110 may inwardly cant toward a central axis x. Alternatively, the lateral arms 110 may be perpendicular to the strut 111. The lateral arms 110 and the arcuate outer tip 112 may be rounded and smooth. For example, the lateral arms 110 and the outer tip 112 may be cylindrical in axial cross-section.

A central interior beam 114 extends from the outer tip 112 toward the web-retaining portion 104 and connects to an interior stud 116. A height of the interior stud 116 may be greater than that of each of the lateral arms 110. Arcuate openings 118 may be formed on either side of the interior stud 116. The arcuate openings 118 may be configured to slidably retain the securing protrusions 72 (shown in FIG. 5) of the female buckle member 10 when the male buckle member 100 is securely mated with the male buckle member 100.

A connecting fin 120 may connect an interior end 122 of the interior stud 116 to the strut 111. Additionally, planar support walls 124 may be formed between each lateral arm 110, the strut 111, the connecting fin 120, and edges that define the arcuate opening 118. Alternatively, the male buckle member 100 may not include the connecting fin 120 and/or the support walls 124. For example, the interior stud 116 may simply extend from the interior beam 114, with openings between the outer edges of the interior stud 116 and lateral arms 110 and the strut 111. Additionally, alternatively, the male buckle member 100 may not include the arcuate openings 118. Instead, the area between the strut 111, the arms 110, and the outer tip 112 may include contiguous material, such as support walls connecting directly to the interior stud 116. Also, alternatively, the interior stud 116 may be sized and shaped differently than shown.

Figure 11:
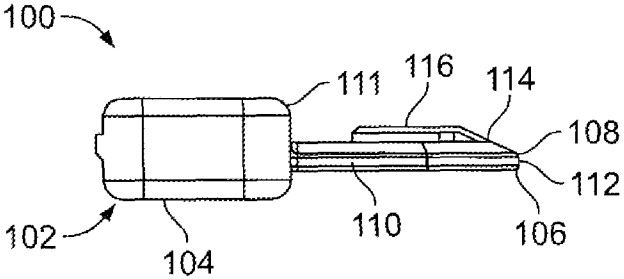
FIG. 11 illustrates a lateral view of a male buckle member, according to an embodiment of the present disclosure.

FIG. 11 illustrates a lateral view of the male buckle member 100. As shown, the interior stud 116 may extend to a height that exceeds that of the lateral arms 110. Further, the central interior beam 114 may be beveled, thereby providing a lead-in nose that is configured to automatically align and lead the insertion member 108 into the insertion channel 40 (shown in FIGS. 1, 4, 5, and 7) of the female buckle member 10.

Figure 12:
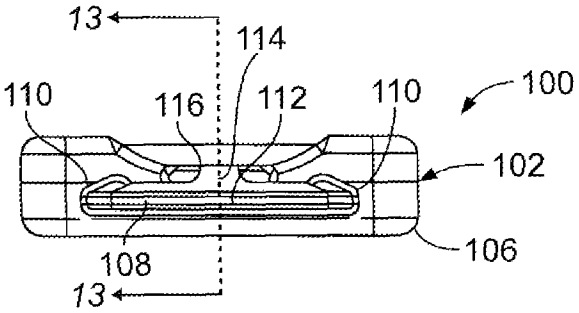
FIG. 12 illustrates a female-insertion end view of a male buckle member, according to an embodiment of the present disclosure.
Figure 13:
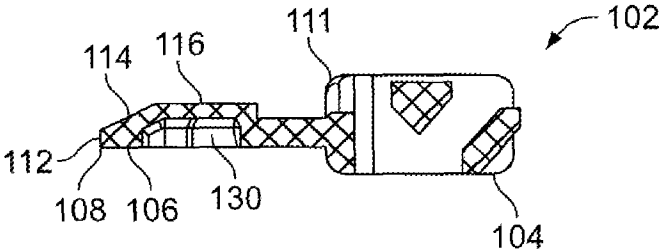
FIG. 13 illustrates a cross-sectional view of a male buckle member through line 13-13 of FIG. 12, according to an embodiment of the present disclosure.

FIG. 12 illustrates a female-insertion end view of the male buckle member 100. FIG. 13 illustrates a cross-sectional view of the male buckle member 100 through line 13-13 of FIG. 12. Referring to FIGS. 12 and 13, the interior stud 116 may include a cored-out underside 130, which reduces material cost and provides a lighter male buckle member 100. In order to connect the male buckle member 100 to the female buckle member 10 (shown in FIGS. 1-7), the male buckle member 100 is urged toward the insertion channel 40 of the female buckle member 10, and the insertion member 108 is mated into the insertion channel 40.

Figure 14:
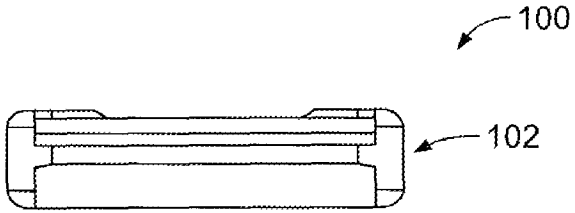
FIG. 14 illustrates a web-retaining end view of a male buckle member, according to an embodiment of the present disclosure.

FIG. 14 illustrates a web-retaining end view of the male buckle member 100. The web-retaining portion 102 is configured to adjustably retain a web member, as described above with respect to the female buckle member 10.

Figure 15:
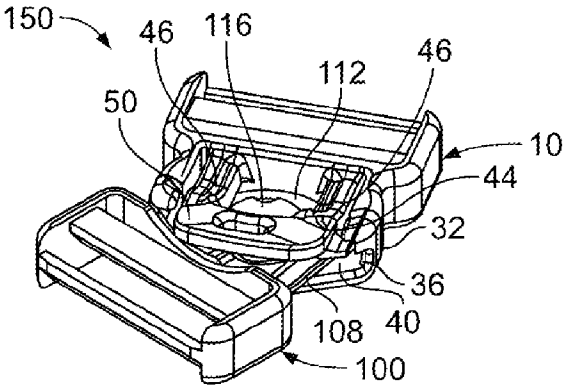
FIG. 15 illustrates an isometric top view of a connected buckle assembly, according to an embodiment of the present disclosure.

FIG. 15 illustrates an isometric top view of a connected buckle assembly 150, according to an embodiment of the present disclosure. In order to connect the male buckle member 100 with the female buckle member 10, the insertion member 108 is aligned with the insertion channel 40. The outer tip 112 is then urged into the insertion channel 40, with the beveled interior beam 114 providing a lead-in feature that automatically vertically aligns the male buckle member 100 with respect to the female buckle member 10. As the insertion member 108 is urged into the female buckle member 10, the interior stud 116 passes under the handle 50 and deflects the handle 50 upwardly. The opposed lateral beams 46 of the securing latch 44 flex and pivot upward, allowing the handle 50 to move in response. Once the interior stud 116 is moved past the handle 50, the handle 50 deflects back down to its at-rest position. During this movement, the securing protrusions 72 (shown in FIG. 5) of the female buckle member 10 snap or otherwise deflect into the arcuate openings 118 (shown in FIGS. 8 and 9, for example). In this manner, the male buckle member 100 may snappably connect to the female buckle member 10. The securing protrusions are slidably retained within the arcuate openings 118, thereby adjustably securing the female buckle member 10 to the male buckle member 100.

Figure 16:
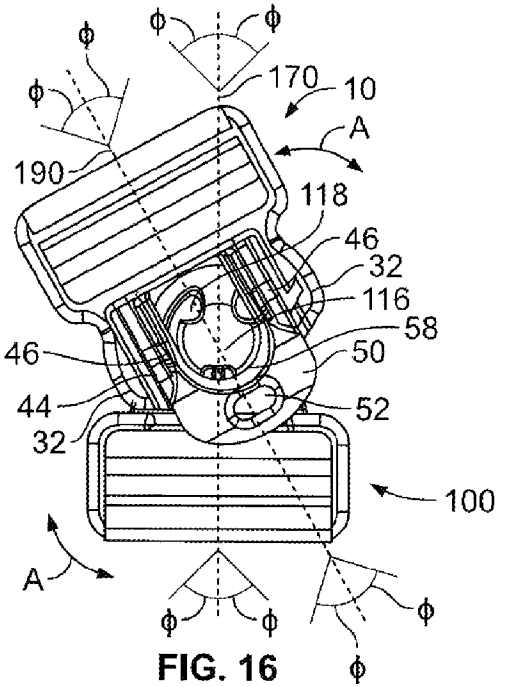
FIG. 16 illustrates a top view of a connected buckle assembly, according to an embodiment of the present disclosure.

FIG. 16 illustrates a top view of the connected buckle assembly 150. Referring to FIGS. 15 and 16, in the connected position, the interior stud 116 is slidably retained against the arcuate interior edge 58 of the handle 50. The contours of the interior stud 116 may generally conform to the contours of the arcuate interior edge 58.

As shown in FIG. 15, in particular, the opposed pivot beams 46 and the handle 50 are generally positioned over a plane of an upper surface of the interior stud 116. As such, the pivot beams 46 and the handle 50 generally protect against the interior stud 116 from being accidentally engaged, touched, or the like. Moreover, in order to disconnect the male buckle member 100 from the female buckle member 10, the handle 50 is pulled in order to disengage the securing protrusions 72 from the arcuate openings 118. Accordingly, instead of a central button being depressed (a movement that may be susceptible to unintentional engagement), the handle 50 is pulled in order to disconnect the assembly 150.

As shown in FIG. 16, in particular, the male buckle member 100 may be pivoted with respect to the female buckle member 10 in the directions of arcs A. The range of pivotal motion may be defined by the length of the arcuate openings 118. That is, the terminal ends of the arcuate openings 118 define barriers past which the securing protrusions 72 may not pass. Further, the notches 36 (shown in FIG. 15, for example) formed in the lateral walls 32 provide expanded areas into which the lateral arms 110 of the insertion member 108 may move. As such, the notches 36 may allow for increased pivotal motion. The arcuate openings 118 may have lengths that are greater or less than shown, in order to tailor a desired range of motion. When the male buckle member 100 is connected to the female buckle member 10, the buckle assembly 150 allows the buckle members 100 and 10 to swivel, pivot, rotate, or the like with respect to one another over a wide sweep, such as +/−30°. However, the assembly 150 may be configured to allow for sweep angles that are greater or less than +/−30°. As shown in FIG. 16, the female buckle member 10 is configured to pivot relative to the male buckle member 100 through an arc of +/−Φ with respect to a central axis 170 of the male buckle member 100, or vice versa. Similarly, the male buckle member 100 is configured to pivot relative to the female buckle member 10 through an arc of +/−Φ with respect to a central axis 190 of the male buckle member 100, or vice versa. In other words, the male buckle member 100 and the female buckle member 10 are configured to pivot relative to one another through an arc of +/−Φ. The angle Φ may be 30°, for example. However, the angle Φ may be greater or less than 30°, depending on a desired sweep angle, which may be dictated by the size and length of the arcuate openings 118, and the angle of the recessed lateral portions 64, for example.

Figure 17:
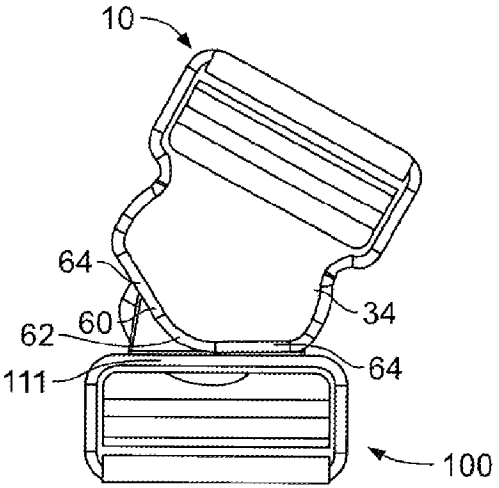
FIG. 17 illustrates a bottom view of a connected buckle assembly, according to an embodiment of the present disclosure.

FIG. 17 illustrates a bottom view of the connected buckle assembly 150. As noted above, the recessed lateral portions 64 of the outer receiving edge 60 of the base 34 of the female buckle member 10 may also define the range of pivotal motion. For example, pivotal motion in each direction is stopped when the recessed lateral portions 64 abut into the strut 111 of the male buckle member 100. The sizes and shapes of the recessed lateral portions 64 and the arcuate openings 118 (shown in FIGS. 8 and 9, for example) may be coordinated with one another, such that when a securing protrusion 72 abuts into a terminal end of an arcuate opening 118, a recessed lateral portion 64 abuts into the strut 111.

Figure 18:
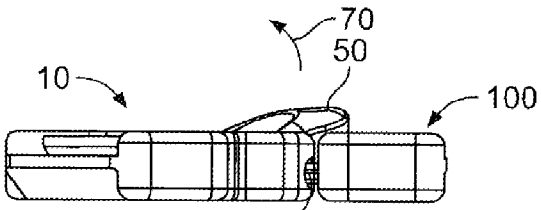
FIG. 18 illustrates a lateral view of a connected buckle assembly, according to an embodiment of the present disclosure.

FIG. 18 illustrates a lateral view of the connected buckle assembly 150. In order to disconnect the assembly 150, the handle 50 is pulled in the direction of arc 70. As the handle 50 is pulled, the securing protrusions 72 (shown in FIG. 5) disengage from the arcuate openings 118 (shown in FIGS. 8 and 9, for example), and the interior stud 116 disengages from the arcuate interior edge 58 of the handle 50. When the securing protrusions 72 are no longer slidably retained with the arcuate openings 118, the insertion member 108 of the male buckle member 100 may be pulled out of the insertion channel 40 of the female buckle member 10, thereby disconnecting the assembly 150.

Instead of pushing down on the interior stud 116, the handle 50 of the female buckle member 10 is pulled upward to disconnect the assembly 150. As noted, the handle 50 may include an opening configured to receive a rope, string, lanyard, or the like, which a user may engage. Optionally, the user may simply grasp the handle 50 between two fingers. In this manner, the handle 50 is configured to be grasped and pulled by an individual.

Therefore, inadvertent bumps into the buckle assembly 150 will not result in an inadvertent disconnection.

Embodiments of the present disclosure provide a rotatable buckle assembly configured to be disconnected through a user pulling up on a portion of a buckle member. For example, the user may directly grasp the handle 50 of the female buckle member 10, or pull up on a lanyard, string, or the like, operatively connected to the handle 50.

Embodiments of the present disclosure also provide a rotatable buckle assembly having a male buckle member 100 that is configured to rotate within a housing of the female buckle member 10. Rotation stops, such as the recessed lateral portions 64, on one or more of the buckle members are configured to prevent over-pivoting or flexing. Additionally, the male buckle member may include a solid tongue that is less susceptible to breaking, as compared to known buckle assemblies.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. A rotatable buckle assembly comprising: a first buckle member including an insertion member; and a second buckle member configured to rotatably connect to the first buckle member, wherein the second buckle member includes a base, a handle connected to the base through opposed pivot beams and an insertion channel configured to receive the insertion member, wherein the insertion member is rotatably retained within the insertion channel when the first buckle member is rotatably connected to the second buckle member, and the handle being configured to be upwardly pulled relative to the base to disconnect the first buckle member from the second buckle member.

2. The rotatable buckle assembly of claim 1, wherein the insertion member comprises an internal stud that conforms to a contour of a portion of the second buckle member, and wherein the internal stud is configured to be rotatably retained by the portion of the second buckle member.

3. The rotatable buckle assembly of claim 2, wherein the second buckle member comprises opposed pivot beams connected to the handle, wherein the handle comprises an arcuate internal edge that rotatably engages the internal stud when the first buckle member is rotatably connected to the second buckle member.

4. The rotatable buckle assembly of claim 3, wherein the opposed pivot beams and the handle are positioned over a plane in which an exposed surface of the internal stud resides.

5. The rotatable buckle assembly of claim 1, wherein the handle comprises a lanyard opening configured to retain a lanyard that is configured to be grasped and pulled.

6. The rotatable buckle assembly of claim 1, wherein the handle comprises an upturned end that is configured to be grasped and pulled.

7. The rotatable buckle assembly of claim 1, wherein the second buckle member comprises a base including an outer receiving edge having recessed lateral portions that are configured to limit rotatable movement of the first buckle member with respect to the second buckle member.

8. The rotatable buckle assembly of claim 1, wherein the insertion member comprises arcuate openings, and wherein the handle comprises securing protrusions configured to be slidably retained within the arcuate openings when the first buckle member is rotatably connected to the second buckle member.

9. The rotatable buckle assembly of claim 1, wherein the first buckle member is configured to pivot through an arc of +/−30° with respect to a central axis of the second buckle member, or vice versa.

10. A rotatable buckle assembly comprising: a male buckle member; and a female buckle member configured to rotatably connect to the male buckle member, wherein the female buckle member comprises a base and a handle connected to the base through opposed pivot beams that is configured to be upwardly pulled relative to the base to disconnect the male buckle member from the female buckle member.

11. The rotatable buckle assembly of claim 10, wherein the male buckle member comprises an insertion member, wherein the female buckle member further comprises an insertion channel configured to receive the insertion member, and wherein the insertion member is rotatably retained within the insertion channel when the male buckle member is rotatably connected to the female buckle member.

12. The rotatable buckle assembly of claim 11, wherein the insertion member comprises an internal stud, wherein the female buckle member further comprises opposed pivot beams connected to the handle, and wherein the handle comprises an arcuate internal edge that rotatably engages the internal stud when the male buckle member is rotatably connected to the female buckle member.

13. The rotatable buckle assembly of claim 12, wherein the opposed pivot beams and the handle are positioned over a plane in which an exposed surface of the internal stud resides.

14. The rotatable buckle assembly of claim 10, wherein the handle comprises a lanyard opening configured to retain a lanyard that is configured to be grasped and pulled.

15. The rotatable buckle assembly of claim 10, wherein the handle comprises an upturned end that is configured to be grasped.

16. The rotatable buckle assembly of claim 10, wherein the female buckle member comprises a base including an outer receiving edge having recessed lateral portions that are configured to limit rotatable movement of the male buckle member with respect to the female buckle member.

17. The rotatable buckle assembly of claim 10, wherein the insertion member comprises arcuate openings, and wherein the handle comprises securing protrusions configured to be slidably retained within the arcuate openings when the male buckle member is rotatably connected to the female buckle member.

18. The rotatable buckle assembly of claim 10, wherein the male buckle member is configured to pivot through an arc of +1-30° with respect to a central axis of the female buckle member, or vice versa.

19. A rotatable buckle assembly comprising:

a male buckle member including an insertion member having an internal stud and arcuate openings around portions of the internal stud; and a female buckle member configured to rotatably connect to the male buckle member, wherein the female buckle member comprises:

a base including an outer receiving edge having recessed lateral portions that are configured to limit rotatable movement of the male buckle member with respect to the female buckle member;

an insertion channel configured to receive the insertion member, wherein the insertion member is rotatably retained within the insertion channel when the male buckle member is rotatably connected to the female buckle member;

a handle that is pulled to disconnect the first buckle member from the second buckle member, wherein the handle comprises (a) an arcuate internal edge that rotatably engages the internal stud when the male buckle member is rotatably connected to the female buckle member, (b) an upturned end that is configured to be grasped and upwardly pulled relative to the base to release the first buckle member from the second buckle member, (c) a lanyard opening configured to retain a lanyard that is configured to be grasped and pulled, and (d) securing protrusions configured to be slidably retained within the arcuate openings when the male buckle member is rotatably connected to the female buckle member; and opposed pivot beams connecting the handle to the base, wherein the opposed pivot beams and the handle are positioned over a plane in which an exposed surface of the internal stud resides.

20. The rotatable buckle assembly of claim 19, wherein the male buckle member is configured to pivot through an arc of +1-30° with respect to a central axis of the female buckle member, or vice versa.

* * * * *